United States Patent [19]

Connell

[11] Patent Number: 4,662,287

[45] Date of Patent: May 5, 1987

[54] TANKER SAFETY SYSTEM

[76] Inventor: Ross M. Connell, 96 Maling Road, Canterbury, Victoria 3126, Australia

[21] Appl. No.: 830,489

[22] Filed: Feb. 18, 1986

Related U.S. Application Data

[63] Continuation of Ser. No. 580,259, Feb. 15, 1984, abandoned.

[30] Foreign Application Priority Data

Feb. 25, 1983 [AU] Australia ..... 8502/83

[51] Int. Cl.[4] ..... E05G 3/00

[52] U.S. Cl. ..... 109/1 S; 280/5 D; 52/168

[58] Field of Search ..... 109/1 S, 28, 29, 53, 109/59 T; 52/168, 169.6, 234; 280/5 D, 5 G

[56] References Cited

U.S. PATENT DOCUMENTS

| | | | |
|---|---|---|---|
| 1,462,347 | 7/1923 | Kramer | 280/5 D |
| 1,675,294 | 6/1928 | Filter | 280/5 D |
| 2,229,793 | 1/1941 | Bradley | 280/5 G |
| 2,239,507 | 4/1941 | Pierce | 280/5 D |
| 2,704,983 | 3/1955 | Van Dronkelaar | 109/1 S |
| 3,996,630 | 12/1976 | Maderna | 52/169.6 |
| 4,174,711 | 11/1979 | Laing et al. | 52/168 |
| 4,301,631 | 11/1981 | Tazaki | 52/168 |

FOREIGN PATENT DOCUMENTS

| | | | |
|---|---|---|---|
| 668880 | 11/1929 | France | 280/5 G |

*Primary Examiner*—Thomas J. Houlo
*Assistant Examiner*—Neill Wilson
*Attorney, Agent, or Firm*—Larson and Taylor

[57] ABSTRACT

A safety system, particularly for use with fire fighting tankers, comprising a device whereby at least part of the contents of the tank can be caused to be rapidly discharged and having a hatch for the ingress into the tank of at least one person, the hatch being capable of being sealed after the person is in the tank so that the person is isolated from the surrounding atmosphere. Preferably the tank has a layer of insulating material thereabout, which layer maintains the temperature within the tank below a dangerous level for a person therein, at least for a period equal to the likely incidence of high temperature thereon.

14 Claims, 4 Drawing Figures

10
11
12
13
14
15
16
16'
17
17'
18
20
22
24
25
26
28
29
30
31
32
33
34
36
40
45
51
53
2
3

TANKER SAFETY SYSTEM

This application is a continuation of application Ser. No. 580,259 filed Feb. 15, 1984, now abandoned.

This invention relates to a tanker safety system and, in particular to a system which is particularly adapted to be used with fire fighting tankers.

The death and injury toll in bush fires in Victoria in February, 1983 has indicated the vunerability of fire fighters operating near the fire front on tankers.

It will be appreciated that, under severe bush fire conditions, the speed of movement of the fire through bush can be exceptionally rapid and the temperatures at the face of the fire and the amount of energy radiated can be exceptionally high.

It is appreciated that any person who is inadvertently engulfed by fires under these conditions can be killed or extremely badly injured from the radiation associated with the fire front or from asphyxiation caused from inhaling hot gasses.

Whilst actual burning occurs if the flames come into direct or near direct contact with a person, this is not normally the initial cause of injury and seldom directly the cause of death, radiation or smoke and fume inhalation generally being more critical.

Because of the speed of movement of the fire it is often difficult to move a vehicle, such as a tanker, from the course of the fire and, even if refuge is taken on the side of the tanker away from the fire, as the fire passes over, whilst there may be some protection from at least a percentage of the likely radiation this still leaves the fire fighters in a position where asphyxiation or other respiratory damage can occur because of extremely hot air and smoke.

It is the principal object of this invention to provide means whereby, under such critical circumstances, where a tanker is about to be engulfed by the fire front, the crew of the tanker have an opportunity to retreat to a position of safety.

The invention includes, in its broadest sense, in the tank on or for a tanker means whereby the tank can be caused to rapidly discharge at least part of its contents which, after discharge, permit ingress into the tank and means whereby the tank can be sealed after such ingress.

Preferably, the means which permit ingress into the tank comprises a hatch in the upper surface of the tank which is of sufficient size to permit a person to pass therethrough.

More specifically, there may be a number of such hatches, through each of which an individual may pass into the interior of the tank and which, on closure, effects the sealing of the tank.

In a preferred form of the invention, the tank has baffles therein and each hatch opens into an area defined by baffles and/or an end wall of the tank.

The means whereby the tank can be caused to rapidly discharge at least part of its content can comprise a dump valve and, in one form of the invention, the dump valve is operated automatically on a hatch being opened.

Alternatively, the means comprises a hatch formed in one end or the side of the tank, which hatch is provided with quick release means whereby the contents of the tank can be dumped, the hatch being of such a size to permit ingress by persons into the tank.

Preferably the tank is made of a heat resisting material and may, as described hereinafter, be provided with means whereby substantially the whole of the internal volume of the tank can be made accessible and can also be provided with auxiliary respiration means.

In order that the invention may be more readily understood, I shall describe, in relation to the accompanying drawings, one particular embodiment of the invention, together with possible variations of this. In these drawings.

The water tank normally carried by fire fighting tankers can be of various shapes, depending upon the preferment of the Fire Service concerned and on the type of vehicle with which the tanker is being used.

Figures 1, 4:
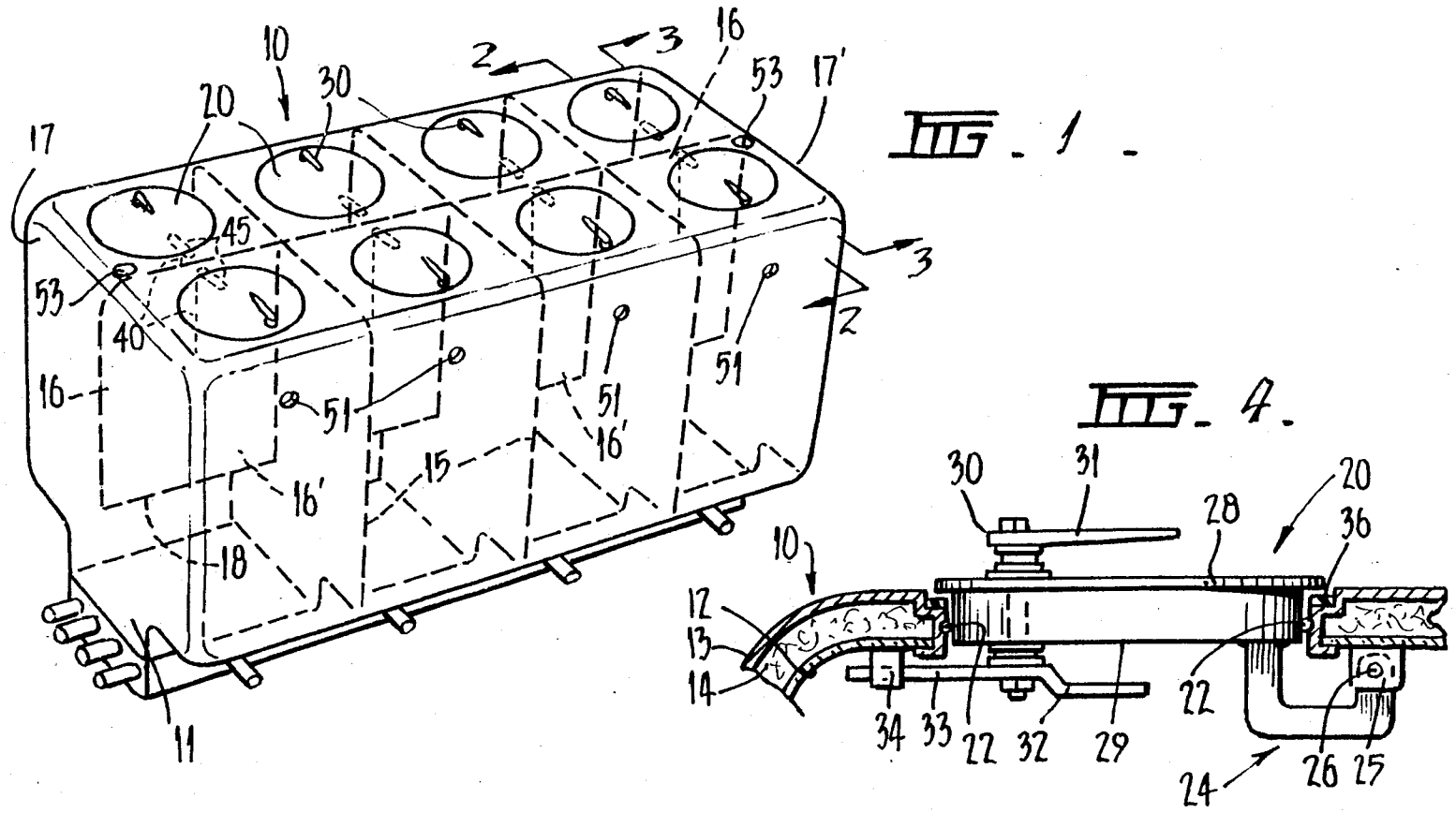
FIG. 1 is a perspective view of a particular form of tank, showing in broken lines the arrangement of the baffles.
FIG. 4 is a partial section showing the arrangement of one of the hatches of FIG. 1.

The tank 10, illustrated in FIG. 1, is a schematic view of one particular form and is shown to be substantially rectangular having a downwardly directed well 11 extending therefrom.

Conventional tankers were, historically, made of metal, normally steel, but, at the present time, the tanks are very often made of aluminum or fibreglass or other fibre reinforced epoxy.

It will be appreciated that the lighter the tank the greater the load of water that can be carried on the tanker.

The tank of the present invention can, in one sense, be considered to be a sandwich of an inner and outer layer although, as will be described hereinafter, the inner portion may be modular in form.

Figure 2:
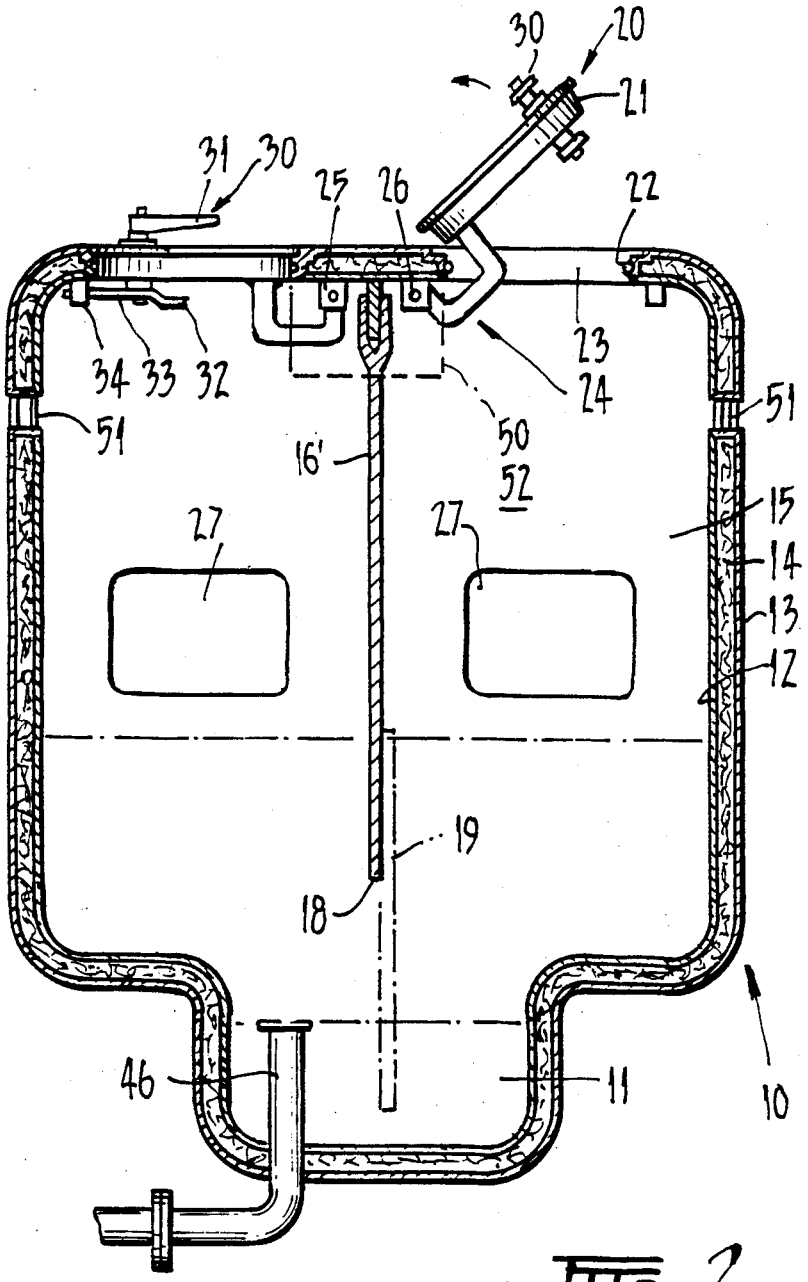
FIG. 2 is a section along line 2—2 of FIG. 1, looking in the direction of the arrows.
Figure 3:
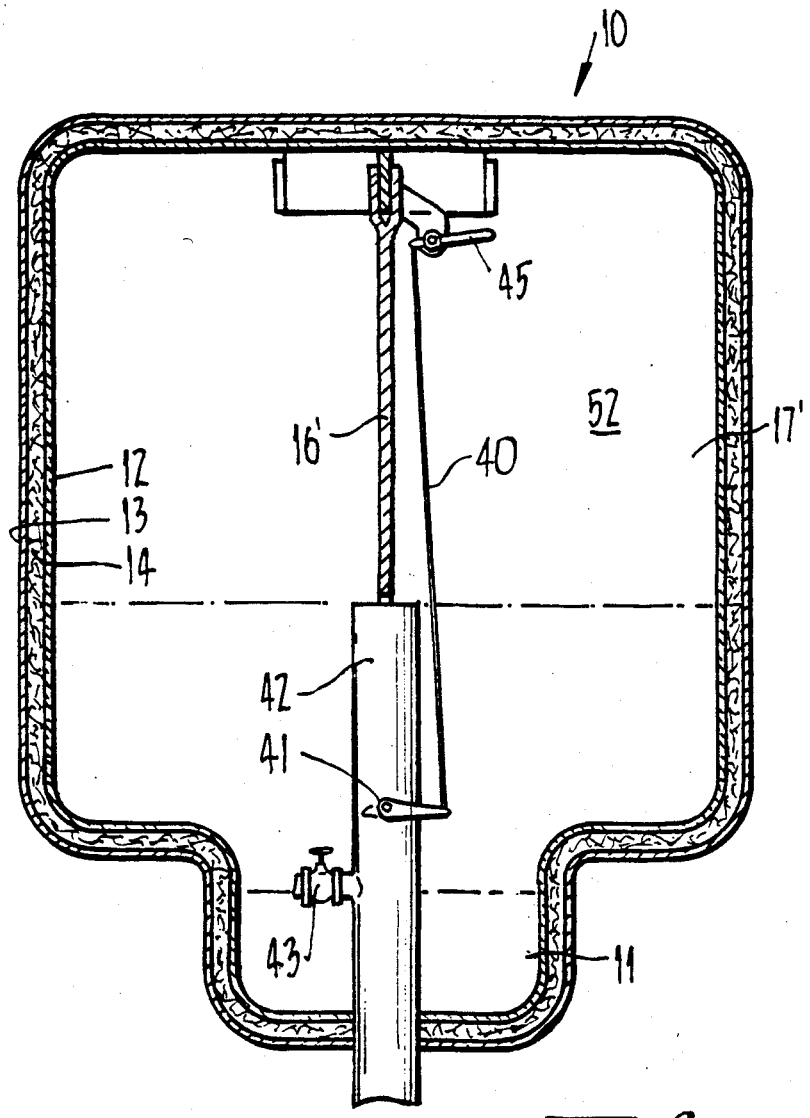
FIG. 3 is a section along line 3—3 of FIG. 1, also looking in the direction of the arrows.

As can best be seen from the sections of FIG. 2 or 3, the water containing inner tank 12 may be of a fibreglass reinforced epoxy, other synthetic material or may be formed from metal such as aluminum or steel.

Located about the exterior of this there is a layer 14 of an insulating material and I have found that a satisfactory material is a ceramic insulating fibre, which is distributed in Australia by Morganite Ceramic Fibres Pty. Limited.

It is a preferment, to increase the efficiency of the insulation, to have the layer 14 as a sandwich, with two fibre batta or sheets surrounding a central reflective foil, preferably an aluminum foil, layer.

The outer tank 13 is preferably of aluminum but could, if required, be of steel or of a synthetic material.

Although the constructional features of the tanks are not shown, the inner tank 12, apart from the various access ports and delivery pipes passing therefrom, is formed so as to be able to receive and retain water.

The inner tank 12 may, if required, be provided with spikes or the like extending outwardly therefrom and a sheet or bat of the insulating material 14, or the insulating sandwich, can overlay the inner tank 12 and be retained thereon by these spikes.

The outer tank 13, which, for strength purposes, is preferably made of a metal, can be partially preformed and can be layed over the inner tank 12 and its insulating covering 14.

The thickness of the insulating covering can vary and, it will be understood from the description later herein, the parameters which have to be taken into account to select this thickness.

Located within the tank there are a number, in this case, three transverse baffles 15 and a single longitudinal baffle 16. It will be appreciated that baffling in tankers is necessary to control surging of the liquid therein during movement and this arrangement of baffles is not unconventional.

Previously, the possibility of making the inner tank 12 in a modular manner was discussed. If this was done the modules would preferably be based about compartments which would comprise the volume between two adjacent transverse baffles 15.

The baffles 15 basically follow the contour of the interior of the tank although, there can be apertures, such as at 27, through these baffles 15 or cut-outs from these baffles 15 to permit the water to find its level.

The apertures 27 in the transverse baffles 15 can be provided with a slide or shutter whereby they can be selectively opened or closed. It will be appreciated that the baffles are not intended to completely prevent movement of water in the tank but, rather, to prevent or restrict surging of water within the tank as the tank is moving.

The longitudinal baffle components 16' are either connected to the two transverse baffles 15 between which they are located, or between a transverse baffle 15 and one end 17, 17' of the tank.

These baffle components, as can be seen from FIGS. 1 and 2, have their lower ends 18 spaced upwardly from the floor of the tank and, in the particular embodiment, upwardly from the well 11 of the tank.

Alternatively, whilst the area under the lower edge of the longitudinal baffles 16 is normally open, it may be preferred to provide a shutter or slide whereby this can be normally closed but can be opened if required, as will be described. This is shown in dotted line in FIG. 2.

Mounted in the top of the tank there are a number of hatches 20 which correspond to the number of cells formed by the baffles 15, 16 and the ends and side walls of the tank.

Preferably, these hatches 20 are of a substantial thickness, as can be seen from FIG. 4.

This thickness enables the hatch to effectively have an upper and lower skin between which insulating material can be provided. In addition, this thickness provides a surface 21 which is adapted to co-operate with gaskets 22, 36 located on a surface which surrounds the periphery of the opening 23 and into which the hatch 20 closes. These gaskets 22, 36 make a good seal between the hatch 20 and the opening 23 when the hatch is closed.

Specifically, the lower gasket 22 can preferably be an O-ring gasket or the like, possibly of silicone rubber, which, when the hatch is closed, provides a water tight and air tight seal. Thus, during normal operation of the tanker this gasket 22 prevents water from being split from the tanker, when, for example, the tank is full and the tanker is travelling over steep or rough terrain.

Where the tank is being used as a refuge, as will be described later, the gasket 22 prevents the ingress of hot air.

The other gasket 36 is preferably made of a ceramic fibre material and provides a heat proof gasket.

Thus, when heat is applied to the exterior of the hatch, whilst there can be a certain amount of conduction along the surface 21 of the hatch and the edges of the opening, the location of the gasket 36 nevertheless presents a substantial resistance to heat transfer.

Mounted, preferably along the upper edge of the tank, and possibly for access from each compartment, there can be bins 50 which can contain breathing apparatus, which may preferably be manifolded from air bottles located beneath or beside the tank, which bottles can also be used, if necessary, as replacement bottles for breathing apparatus, say, if the tanker is being used for a house fire or in some area where breathing apparatus is required.

In at least one of the bins there may also preferably be provided a radio transceiver connected to an external antenna so that contact can be made with other mobile units or a base station. Alternatively, each bin may have a connection to the antenna so that a transceiver can be rapidly connected thereto.

Also, in association with the bins there can be a light or lights whereby the interior of the tank can be, at least partially, illuminated.

As illustrated, each hatch is provided with a hinge 24 to enable it to be connected to a lug 25 in the tank within the tank which contains the hinging axis 26 thereof. The hatch 20 can move from a position where it closes the aperture 23 to a position where it is effectively fully clear of the aperture and provides only minimal obstruction thereof.

Each hatch is provided with a locking means 30 which includes an upper handle 31 on the exterior of the tank, a lower handle 32 within the tank and, associated with the lower handle, an arm 33 which is adapted to be located beneath a clip 34 on the inner surface of the tank, when the hatch is closed.

As previously described, there are two seals 22,36 between the hatch and the aperture 23, the outer seal 36 being a heat seal, but not necessarily a water seal and the inner seal 22 being a water seal.

Preferably, I provide, in association with all of the hatches 20, a handle 45 which is in connection with an operating lever or the like 40 as shown in detail in FIG. 3. Lever 40 extends downwardly into the body of the tanker to a valve 41 which is located in a pipe 42 which extends upwardly for approximately one-third of the height of the tank. The particular arrangement of levers to operate the valve 41 is not shown.

This arrangement is such that, when the hatch 20 is opened and the handle 45 is operated, the lever 40 causes the valve 41 to open fully to rapidly dump, through the pipe 42, any water in the tank which is above the top of the pipe. Alternatively, the lever 40 can be connected directly to the hatch. Thus automatically opening a valve to which such a hatch is connected. It may be preferred that the valve therefore, be connected to each hatch whereby, there is an immediate and rapid dumping of a substantial part of the liquid in the tank, provided that this is above the level of the pipe 42. In either case, the dumping of the water provides an air space as will be described hereinafter.

I may prefer to provide a second dump valve 43 which opens into the pipe 42 whereby, if it is required that the level of the water be brought down to the well 11, this valve can be opened and water can flow into the pipe 42 to water.

Depending upon the application, the second valve may be at approximately the level shown or it may even be arranged to effectively dump the whole of the water from the tank.

Depending upon the requirements a stand pipe 46, which can be considered to be connected to the tanker pump for filling or emptying the tank, is spaced at a distance from the floor of the well 11 to ensure that there is normally water remaining in the lower portion of the well.

In the side walls of the tank, and as illustrated in association with each of the compartments, there is an inspection opening 51, which is shown as double glazed, and through which the occupant of a compartment can examine the course of the fire externally of the tanker.

In operation, under normal circumstances, the tanker is used in a completely conventional way.

If required, the tanker can be filled by its pump, for example, feeding in through the stand pipe 46, or, could be filled from an overhead stand pipe or from a pump, either the tanker's pump or a pump separate therefrom and I prefer to provide filling openings 53 which can be sealed when not in use.

Filling could be done through one of the hatches 20, but I prefer not to use these as the seals 22, 36 could be damaged.

There may be an overflow, not shown, which prevents over filling of the tank and, in some applications, the tank may be made higher than required and, under such circumstances, it is desirable to permit it to be filled only to a predetermined level.

Under normal circumstances, the hatches 20 are all sealed, although there is means whereby air can enter the tank to compensate for water removed therefrom by the pump.

If, however, the tanker is in a position where the lives of the crew are at risk, it provides a number of cells, in the illustrated embodiment eight, into which the members of the crew may enter.

The actual sizes of these cells will depend on the size of the tank and there may be a variable number depending upon this size.

The size of each individual cell may also vary but, normally, a cell of approximately 50 cm square and something over 100 cm high would be sufficient for normal persons, although a cell slightly larger than this may be desirable.

If the tanker is placed in a risk situation, each crew member will open the hatch of the compartment allotted to him and either the dump valve or valves 41 will be opened automatically or can be opened simply by operation of the handles 45 so that the level of the water drops to the upper broken horizontal line in FIGS. 2 and 3.

This creates an air space 52 in each compartment so that, if a crew member enters any compartment and closes the hatch 20, the upper portion of his body is in this air space.

If it is required to dump further water, it is only necessary that the valve or valves 43 be opened and the level of the water will drop to that of the lower of the two broken lines, into the well 11.

Depending upon the size of the fire fighters and the particular arrangement of the lower edge 18 of the transverse baffle, so the crewmen could sit or squat in the compartment and, if the slide 19 is not provided, may pass their legs to the other side of the tank, or can open the slide 19 to provide room to so pass their legs.

Individuals can thus have some contact with the person in the opposite compartment and the aperture 27, if necessary, after a slide has been moved can give contact with adjacent compartments.

When entering the compartments, the crew members can open the bins 50, or again, the bins can be automatically opened on the opening of the hatch 20 and respiration equipment can be provided therefrom for use by the particular crew member.

Because of the provision of the insulating layer 14, notwithstanding extremely high external temperatures and as previously mentioned, these are normally only for relatively short periods, the interior of the tank remains at an acceptable temperature and, particularly if the breathing apparatus is being used, the crew men are breathing air which is at a perfectly acceptable temperature.

Whilst in the tank, contact can be made with the outside by way of radio equipment and the members of the crew can generally talk to each other to maintain morale and to prevent any panic.

After a relatively short period, say ten to fifteen minutes, when it is clear that the fire front has passed, the hatches 20 can be opened and either the crew can stay in relative safety within the tank or, if it then appears safe to do so, can leave the tank. This may be desirable if the tanker itself is burning although, even under these circumstances, it may be safer to remain within the tank until rescue can be effected.

In the fully described embodiment of the invention, I have discussed compartments, each of which can receive an individual crew member.

It may, alternatively, be possible to provide a similar arrangement by providing a door in the rear or side of the tank which can permit access, either together with dumping the tank contents or, after the contents have been dumped by a dump valve, to the interior of the tank and it may be possible to provide means whereby the baffling in the tank can either be collapsed or rapidly moved to permit access into the tank of a number of people.

As mentioned earlier, depending upon the physical form of tank used, so the particular construction features may readily be varied.

I claim:

1. A water tank on or for a water tank vehicle, said tank including;

a normally closed ingress means to permit ingress of at least one person into the tank, a dump valve means connected to the tank for causing rapid discharge of the contents of the tank above a predetermined level of about one third of a height of the tank so as to enable person(s) to safely enter the tank in the event of a fire;

the means permitting ingress including a seal means for sealing the ingress means such that after the person(s) has entered the tank the person(s) is isolated from the atmosphere external to the tank.

2. A tank as claimed in claim 1 wherein the means permitting ingress into the tank comprises a hatch in the upper surface of the tank, which hatch is of sufficient size to permit a person to pass therethrough.

3. A tank as claimed in claim 2 wherein there are a number of said hatches, through each of which an individual may pass into the interior of the tank and which, on closure, effect the sealing of the tank.

4. A tank as claimed in claim 3 wherein the tank includes baffles therein forming a plurality of vertical cells, each said cell defined by the baffles and/or an end wall of the tank and having a respective said hatch opening into a respective said cell.

5. A tank as claimed in claim 1 having connecting means for actuating the dump valve means located adjacent said ingress means and in the tank whereby the dump valve means is operable after the ingress means is opened.

6. A tank as claimed in claim 1 wherein the tank has a water-tight inner container with an insulating material located thereabout.

7. A tank as claimed in claim 6 wherein there is an outer container encompassing the insulating material.

8. A tank as claimed in claim 7 wherein the thickness of the insulating material is sufficient to maintain a safe physiological environment within the tank when the tank is subjected to heat produced by a fire front wherein the duration of heat is that substantially equal to the likely time of contact of the tank with the fire front.

9. A tank as claimed in claim 1 wherein inside the tank there is provided a means for storing breathing apparatus for use by occupants thereof.

10. A portable water tank which is mounted on a vehicle comprising:

an outer tank, an inner tank spaced slightly from said outer tank in which water is contained, and a heat insulating material located between said outer tank and said inner tank wherein the thickness of the insulating material is sufficient to maintain a safe physiological environment within the tank when the tank is subjected to heat produced by a fire front wherein the duration of heat is that substantially equal to the likely time of contact of the tank with the fire front;

a central longitudinal baffle and at least one lateral baffle for dividing said inner tank into a plurality of vertical cells, said longitudinal baffle being spaced vertically from a bottom of said inner tank such that a user in one cell may pass their legs under said longitudinal baffle to an adjacent cell;

an ingress means at the top of each cell for providing ingress of a person to each said cell, said ingress means including an insulating hatch, a fluid sealing means operative with said hatch for fluidly sealing said cell relative to said hatch, and a heat sealing means operative with said hatch for thermally insulating said cell relative to said hatch;

a dump valve means connected to said inner tank for rapidly discharging a portion of the water contained in said inner tank above a level of one third of the height of said inner tank so as to enable persons to enter said cells safely in the event of a fire; and a plurality of connecting means for actuating said dump valve means, a respective said connecting means being located in a respective said cell immediately adjacent a respective said hatch.

11. A portable water tank as claimed in claim 10 and further including a small window through the inner and outer tanks in each said cell.

12. A portable water tank as claimed in claim 11 wherein said longitudinal baffle includes a lower end which is adjustable vertically.

13. A tank as claimed in claim 10 wherein said dump valve means only discharges water in the tank above about one-third of a height of the tank.

14. A portable water tank which is mounted on a vehicle comprising:

an outer tank, an inner tank spaced slightly from said outer tank in which water is contained, and a heat insulating material located between said outer tank and said inner tank;

a central longitudinal baffle and at least one lateral baffle for dividing said inner tank into a plurality of vertical cells, said longitudinal baffle including a lower end which is adjustable vertically;

an ingress means at the top of each cell for providing ingress of a person to each said cell, said ingress means including an insulating hatch, a fluid sealing means operative with said hatch for fluidly sealing said cell relative to sid hatch, and a heat sealing means operative with said hatch for thermally insulating said cell relative to said hatch;

a dump valve means connected to said inner tank for rapidly discharging at least a portion of the water contained in said inner tank so as to enable persons to enter said cells safely in the event of a fire; and a plurality of connecting means for actuating said dump valve means, a respective said connecting means being located in a respective said cell immediately adjacent a respective said hatch.

* * * * *